United States Patent [19]

Hughes et al.

[11] Patent Number: 4,527,857

[45] Date of Patent: Jul. 9, 1985

[54] TERMINAL FOR CONNECTING A WIRE TO A BLADE TYPE TERMINAL

[75] Inventors: Donald W. K. Hughes, Mechanicsburg; Donald L. Metzger, Harrisburg; Charles E. Reynolds, Mechanicsburg, all of Pa.

[73] Assignee: AMP Incorporated, Harrisburg, Pa.

[21] Appl. No.: 485,763

[22] Filed: Apr. 18, 1983

[51] Int. Cl.[3] ..... H01R 13/20; H01R 11/20

[52] U.S. Cl. ..... 339/258 S; 339/97 R; 339/256 SP; 339/253 R

[58] Field of Search ..... 339/96, 97 R, 97 C, 339/97 P, 98, 99 R, 258 R, 253 R, 258 P, 256 R, 256 SP, 258 S, 91 R

[56] References Cited

U.S. PATENT DOCUMENTS

| | | | |
|---|---|---|---|
| 3,792,420 | 2/1974 | Konnemann et al. | 339/258 R |
| 4,143,935 | 3/1979 | Goodman et al. | 339/99 R |
| 4,159,158 | 6/1979 | Weidler | 339/97 P |
| 4,408,524 | 10/1983 | Weidler | 339/278 C X |
| 4,445,748 | 5/1984 | Evans | 339/98 X |

FOREIGN PATENT DOCUMENTS

| | | |
|---|---|---|
| 0013308 | 7/1980 | European Pat. Off. . |
| 2050712 | 7/1981 | United Kingdom . |
| 2084814 | 4/1982 | United Kingdom . |

*Primary Examiner*—Gil Weidenfeld
*Assistant Examiner*—Steven C. Bishop
*Attorney, Agent, or Firm*—F. W. Raring

[57] ABSTRACT

Stamped and formed electrical terminal has a conductor-receiving portion comprising parallel plate-like members having aligned conductor-receiving slots. The terminal has a transition portion intermediate the ends thereof and has a contact portion extending from the transition portion. The transition portion comprises first and second sections which extend from the plate-like members. Each section has an arcuate cross section part adjacent to the plate-like member which fairs into a part having a U-shaped cross section. The contact portion comprises one or more arms that extend from at least one of the U-shaped parts. In one embodiment, each U-shaped part has two contact arms extending therefrom which are resiliently biased against each other to provide contact force on a complementary terminal when the two terminals are coupled.

14 Claims, 18 Drawing Figures

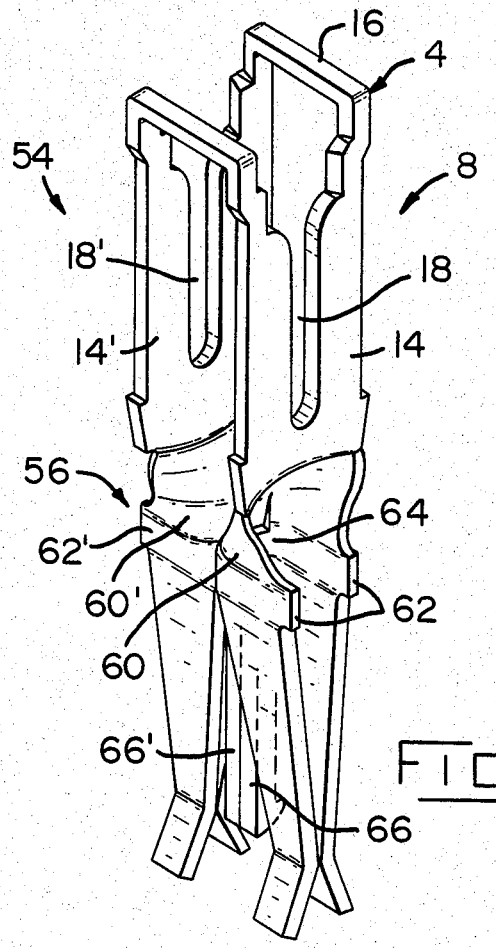
FIG.10
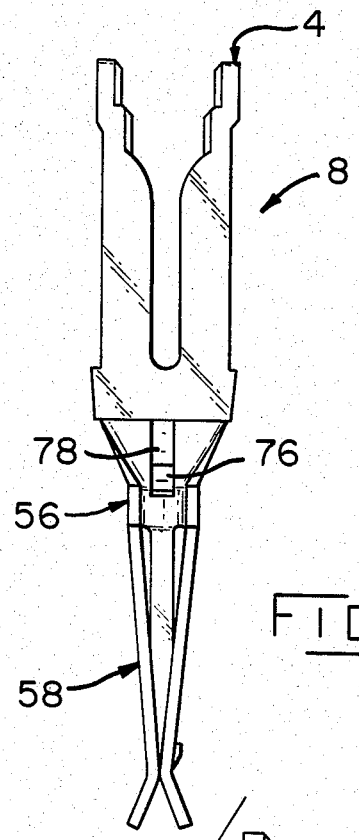
FIG.11
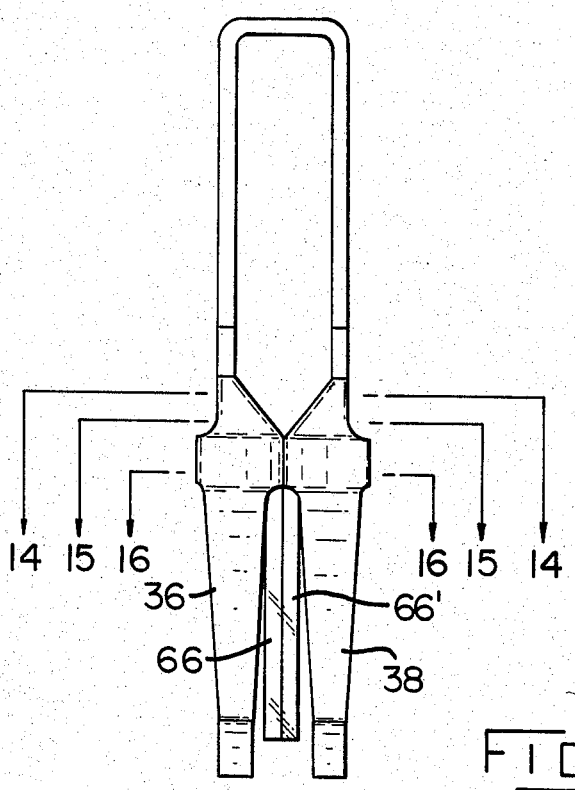
FIG.12
FIG.13
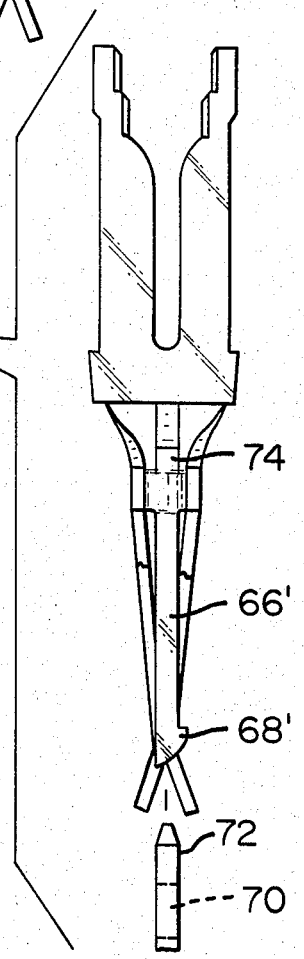

TERMINAL FOR CONNECTING A WIRE TO A BLADE TYPE TERMINAL

FIELD OF THE INVENTION

This invention relates to stamped and formed electrical terminals of the type having a pair of substantially parallel plate-like members in which there are provided conductor-receiving slots. Terminals of this type have a contact portion extending from the plate-like members for engagement with a complementary terminal thereby to connect a conductor in the conductor-receiving slot to a complementary terminal.

BACKGROUND OF THE INVENTION

U.S. Pat. No. 4,159,158 describes a sheet metal electrical terminal comprising parallel spaced apart plate-like members which have aligned conductor-receiving slots. The terminal further has a contact portion comprising side-by-side arms that extend from the plate-like members and which engage a complementary contact terminal when the two terminals are mated. Terminals of the type shown in U.S. Pat. No. 4,159,158 have come into widespread usage and are highly regarded for the reason that a conductor can be connected to the terminal by merely moving the conductor laterally of its axis and into the conductor-receiving slots. A variety of tools and automatic machines have been developed for connecting individual conductors to terminals contained in an insulating housing. Terminals of the general type described in the above-identified U.S. patent thus permit manufacture of electrical harnesses at minimum cost and in a variety of forms.

Presently available terminals of the general type shown in U.S. Pat. No. 4,159,158 are somewhat limited as regards the characteristics of the contact portion of the terminal. The terminal shown in that patent has a contact portion comprising side-by-side arms which receive a complementary terminal post between their opposed surfaces. Because of the manner in which these terminals are manufactured, the side-by-side arms cannot conveniently be resiliently biased against each other and the terminal is therefore limited with regard to the amount of contact force which can be developed when the terminal is mated with a complementary terminal. Under some circumstances, a relatively high contact force is required and existing terminals of the type shown in U.S. Pat. No. 4,159,158 are incapable of satisfying the requirement of a high contact force.

In accordance with one aspect thereof, the invention is directed to the achievement of a terminal of the general type disclosed in U.S. Pat. No. 4,159,158 having contact arms which are resiliently biased against each other thereby to provide a relatively high contact force when the terminal is mated with a complementary terminal.

A further shortcoming of terminals of the general type shown in U.S. Pat. No. 4,159,158 is that when such terminals are assembled to a multi-conductor connector, the terminals must be positioned in side-by-side spaced apart relationship and the contact portions of the terminals are such that the connector cannot be designed to be mated with a plurality of simple terminal tabs which are disposed in parallel planes with each terminal located relatively close to its immediate neighbors. It is common practice in the manufacture of many electrical devices to provide simple rectangular tabular tabs in spaced-apart relationship with the tabs in parallel planes and a connector for an array of tabs must be capable of being mated with the tabs.

In accordance with a further aspect thereof, the present invention is directed to the achievement of a terminal which can be assembled to a connector housing and which can be mated with closely spaced terminal tabs in side-by-side relationship with the tabs in parallel spaced apart planes.

In accordance with further aspects thereof, the invention is directed to the achievement of a terminal which can be provided with a wide variety of contact portions to satisfy varying requirements in electrical connectors; for example, the terminal may be provided with contact arms for engagement with a tab, or with an integral rectangular tab for engagement with a complementary receptacle terminal, or with a cylindrical contact portion for engagement with a cylindrical socket on a complementary terminal.

A preferred embodiment of the invention comprises a stamped and formed electrical terminal of the type having a conductor-receiving end and a contact end, a conductor-receiving portion extending from the conductor-receiving end and a contact portion extending from the contact end, and a transition portion between the conductor-receiving portion and the contact portion. The conductor-receiving portion comprises first and second aligned flat plate-like members which are connected to each other, the plate-like members having aligned conductor-receiving slots so that a conductor can be moved laterally of its axis and into the conductor-receiving slots. The transition portion and the contact portion each comprise first and second sections which extend in side-by-side relationship from the first and second plate-like members respectively. The terminal is characterized in that at least the first section of the transition portion has an arcuate surface which is contiguous with the first plate-like member and has a generally U-shaped part at the juncture with the contact portion. The arcuate surface of the first section fairs from a surface of maximum radius to a surface of minimum radius which in turn merges with the U-shaped part of the first section of the transition portion. The U-shaped part has opposed sidewalls which are connected to each other by a web. The contact portion comprises at least one contact arm which extends from the U-shaped part of the first section.

In accordance with further embodiments, the second section of the transition portion is a substantial mirror image of the first section of the transition portion and the contact portion comprises at least a first pair of contact arms, each of which extends from one of the sidewalls of the U-shaped part of the first section of the transition portion.

In accordance with further embodiments, the first pair of contact arms extend convergently towards each other and are resiliently biased against each other at a location proximate to the contact end.

In accordance with further embodiments, the first and second aligned plate-like members of the conductor-receiving portion are connected to each other by spaced-apart connecting straps at the conductor-receiving end of the terminal. In an alternative embodiment, the first and second aligned plate-like members have corresponding side edges and the first and second plate-like members are connected to each other by a connecting web which extends between one corresponding pair of side edges.

In accordance with a further embodiment, the arcuate surfaces of the first and second sections of the transition portion are concave with respect to a medial plane that extends parallel to, and is between the planes of, the first and second plate-like members and the U-shaped parts of the first and second sections are opposed to each other with the webs of the U-shaped parts remote from each other and with the sidewalls of the first and second sections adjacent to each other. In an alternative embodiment, the arcuate surfaces of the first and second sections of the transition portion are convex with respect to a medial plane that extends parallel to, and is between the planes of, the first and second plate-like members and the U-shaped parts of the first and second sections are opposed to each other with the webs of the U-shaped parts adjacent to each other and with the sidewalls of the first and second sections remote from each other.

In accordance with a further embodiment, the contact portion comprises first and second pairs of contact arms in the first and second sections respectively, each pair of contact arms projecting as extensions of the sidewalls of the U-shaped parts of the first and second sections of the transition portion. The contact arms of each pair extend convergently towards each other and are resiliently biased against each other at a location proximate to the contact end of the terminal.

In accordance with a further embodiment, at least one latch arm is provided in the contact portion for latching the terminal to a complementary terminal, the latch arm projecting as an extension of the web of the U-shaped part of the first section, the latch arm having engaging means for engaging complementary engaging means on a complementary terminal. In an alternative embodiment, a second latch arm projects as an extension of the web of the U-shaped part of the second section. A further embodiment has a locking ear which extends from the web portion of the U-shaped part of one of the sections laterally of the longitudinal axis of the terminal to the web portion of the U-shaped part of the other section and is in locking engagement with the other section.

DESCRIPTION OF THE DRAWINGS

FIG. 10 is a perspective view of another form of terminal in accordance with the invention.

FIG. 11 is a side view of the terminal of FIG. 10.

FIG. 12 is an end view of the terminal.

FIG. 13 is a side view partially in section showing the side which is opposite to the side shown in FIG. 11.

Figure 1:
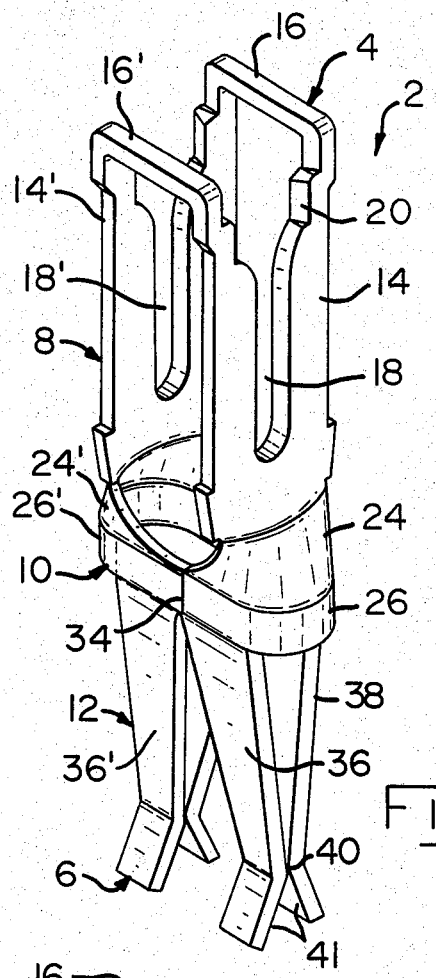
FIG. 1 is a perspective view of one type of electrical terminal in accordance with the invention.
Figure 2:
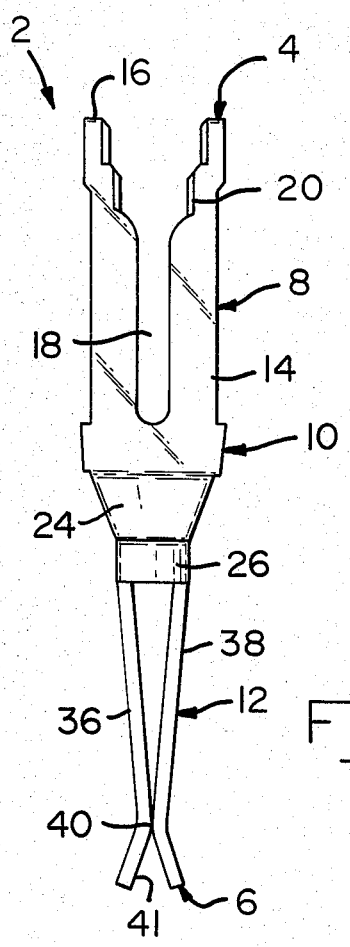
FIG. 2 is a side view of the terminal of FIG. 1.
Figure 3:
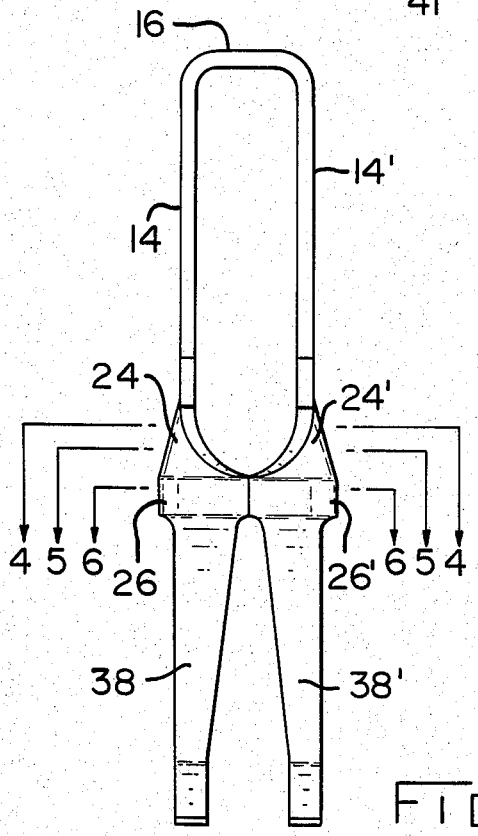
FIG. 3 is an end view of the terminal of FIG. 1.

Referring first to FIGS. 1–3, a terminal 2 in accordance with the invention has a conductor-receiving end 4, a contact end 6, a conductor-receiving portion 8 extending from the contact end, a contact portion 12 extending from the contact end 6, and a transition portion 10 which is between the conductor receiving portion and the contact portion.

The conductor-receiving portion 4 comprises parallel spaced-apart plate-like members 14, 14' which are connected to each other at the end 4 by spaced-apart connecting straps 16. The plate-like members 14, 14' have aligned conductor-receiving slots 18, 18' and the slots are stepped or enlarged adjacent to the end 4 as shown at 20. A conductor such as an individual wire 22 can be connected to the terminal by moving it laterally of its axis between the straps 16, and into the slots 18, 18'.

The transition portion 10 and the contact portion 12 each comprise two sections which extend from the plate-like members 14, 14' to the contact end 6 of the terminal. The sections are substantial mirror images of each other so that a description of the section on the right in FIG. 1 will serve for both sections. The same reference numerals, differentiated by prime marks, are used to denote the structural parts of the two sections.

Figure 4:
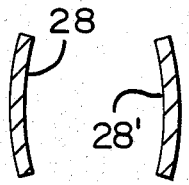
FIGS. 4, 5, and 6 are views taken along the section lines 4—4, 5—5, and 6—6 of FIG. 3.
Figure 5:
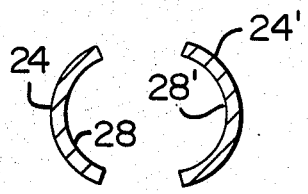
Figure 6:
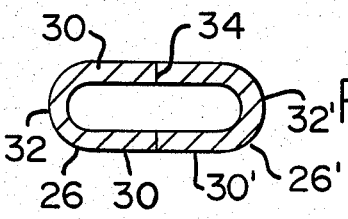

The section of the transition portion 10 which extends from the plate-like member 14 has an arcuate part 24 adjacent to the plate-like member and has a U-shaped part 26 from which the contact portion 12 extends. The arcuate part 24 has an internal surface 28, FIG. 4, which is concave with respect to a medial plane that extends parallel to, and is midway between, the plate-like members 14, 14'. The arcuate part 24 has a maximum radius of curvature where it adjoins the plate-like member 14 and this radius of curvature decreases with increasing distance from the plate-like member as shown by FIG. 5. The arcuate part 24 thus merges with the U-shaped part 26 of the transition portion 10. The U-shaped portion has sidewalls 30 which are connected to each other by an integral web 32, FIG. 6. The edges of the sidewalls are substantially against each other as also shown at 34.

The contact portion 12 comprises contact arms 36, 38 which extend from the U-shaped part 26 and contact arms 36', 38' which extend from the U-shaped part 26'. These contact arms are of decreasing width along their lengths as shown in FIG. 3 and have opposed surfaces which are resiliently biased against each other, as shown at 40, adjacent to the contact end 6 of the terminal. The end portions 41 of the arms 36, 38 diverge to facilitate mating of the terminal with a terminal tab 42 as will be described below.

Figure 7:
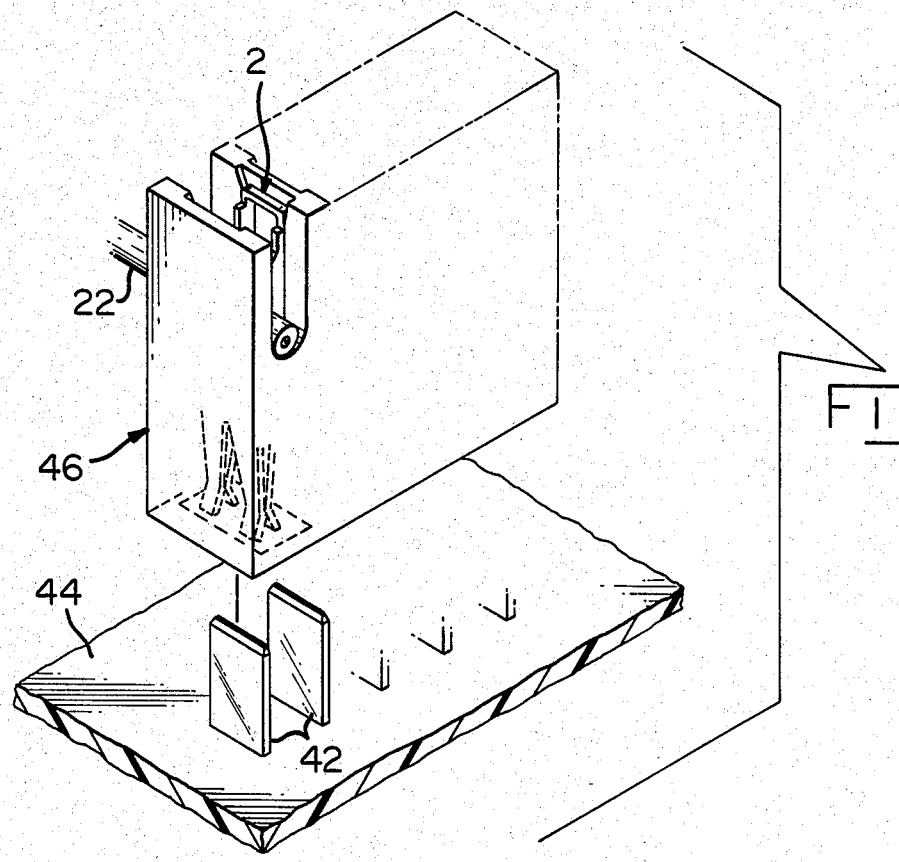
FIG. 7 is a perspective view showing a multi-contact connector housing having terminals as shown in FIG. 1 therein which is intended to be coupled to terminal tabs extending from a support or housing.

FIG. 7 shows a plurality of terminal tabs 42 which are arranged in spaced-apart relationship and in parallel planes. These tabs extend from one surface of a housing or support 44. It is common in the design of many types of electrical equipment such as timers or relays to provide tabs on closely-spaced centers as shown in FIG. 7 for mating with terminals in a multi-contact electrical connector as shown at 46. The connector 46 contains a plurality of terminals 2 in side-by-side relationship with the wires 22 extending in the conventional manner into slots in one sidewall of the connector 46. When the terminals 2 are assembled to the housing as shown in FIG. 7, the pairs of contact arms 36, 38, 36', 38', will be oriented such that they will receive the individual terminal tabs 42 therebetween.

Figure 8:
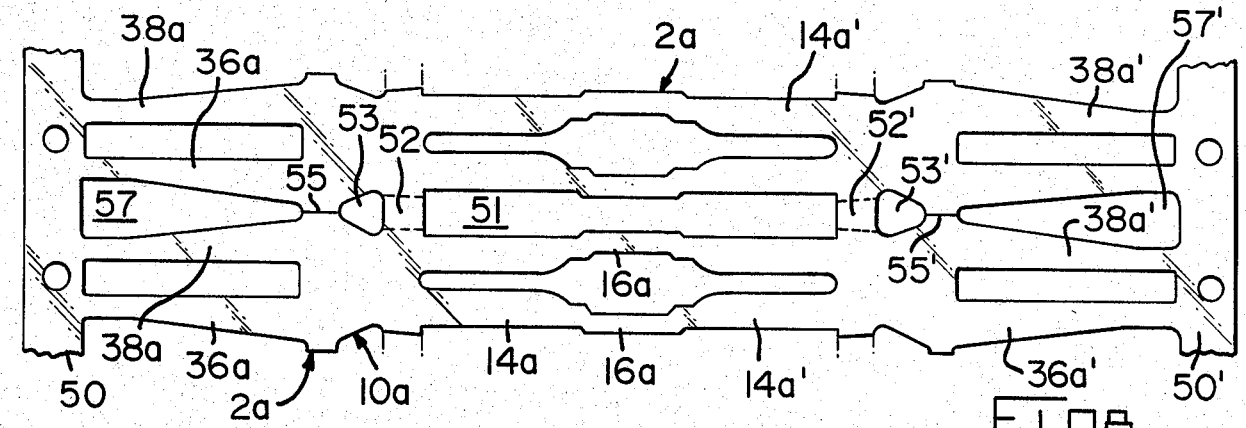
FIG. 8 is a plan view of a short section of a strip of blanks from which terminals as shown in FIG. 1 are produced.

Terminals of the type shown at 2 are manufactured by stamping and forming conductive sheet metal. Initially, the strip is blanked to produce terminal blanks 2*a* in side-by-side relationship with the ends of the contact arms 38*a*, 36*a*, 36*a'*, 38*a'* integral with parallel spaced-apart carrier strips 50, 50'. The reference numerals applied to the parts of the blanks 2*a* shown in FIG. 8 are the same as the numerals used in the foregoing description of the formed terminal and are differentiated by the letter "a" as indicated. Each blank 2*a* is separated from adjacent blanks by a central opening 51 in the strip which extends beside the portions 14*a*, 14*a'* which become the plate-like members 14, 14'. Additional openings between the blanks are provided at 53 and 53', these openings being beside the portions 10*a* and 10*a'* which become the transition portions of the finished terminal. The strip is sheared along shear lines 55, 55' which extend from the openings 53, 53' towards relatively larger openings 57, 57' which separate the contact arm portions of adjacent blanks. Each blank 2*a* is also connected to its intermediate neighbors by connecting sections 52, 52' which are between the opening 51 and the openings 53, 53'.

Figure 9:
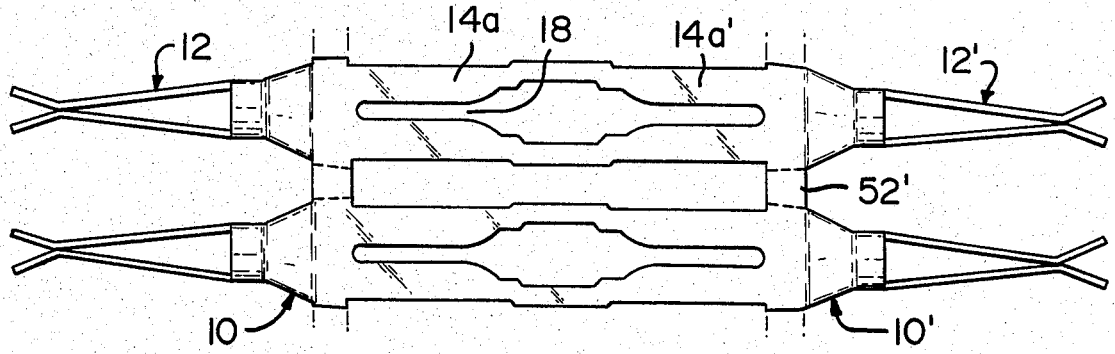
FIG. 9 is a view similar to FIG. 8 which illustrates the forming of a terminal from a blank as shown in FIG. 8.
Figure 14:
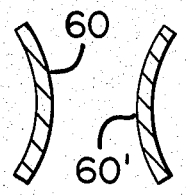
FIGS. 14, 15, and 16 are views taken along the lines 14—14, 15—15, and 16—16 of FIG. 12.

In forming the terminal from the blank of FIG. 8, the carrier strips 50, 50' are first removed by severing the ends of the contact arm portions 36*a*, 38*a*, 36*a'*, 38*a'*, from the carrier strips 50, 50'. Thereafter, the transition portions 10, 10' of the terminal are formed as illustrated in FIG. 9. This forming step requires that the sections 10*a*, 10*a'* of the blank be formed into the arcuate and U-shaped parts 24, 26 of the finished terminal and in forming these transition sections, the contact arms 36*a*, 38*a*, 36*a'*, 38*a'*, are rotated from the planes shown in FIG. 8 towards each other until they are brought into contact with each other as shown at 40 in FIG. 2. Because of the extreme amount of cold working with resulting work hardening and strengthening which is imparted to the portions 10*a*, 10*a'* of the blank during this operation, the contact arms will be held against each other securely by the U-shaped parts 26, 26' of the terminal.

The connecting sections 52, 52' may remain in the blank during the forming operation shown in FIG. 9 and one of these sections may be removed after partial forming in a punching operation so that the adjacent partially formed blanks are connected to each other by only one of the sections 52'. Thereafter and while the partially formed blanks are still in the form of a continuous strip, the individual blanks are folded along spaced-apart fold lines 48, 48' to produce the fully formed terminals. The remaining connecting section 52' can then be removed by a punching operation when the individual terminals are inserted into cavities in a housing as shown at 46.

Figure 15:
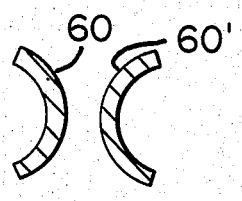

FIGS. 10–13 show an alternative terminal 54 in accordance with the invention having a conductor receiving portion 8 and an upper end 4 which is identical to the conductor-receiving portion and the upper end of the terminal of FIG. 1. The parts of this conductor-receiving portion of terminal 54 are therefor identified with the same reference numerals as are used in FIG. 1. The transition portion 56 of the terminal 54 has arcuate surfaces which extend from the plate-like members 14, 14' that are convex as shown at 60, 60' with respect to a medial plane that extends parallel to, and is between the plate-like members 14, 14'. The radius of curvature of the convex surfaces 60, 60' decreases with increasing distance from the plate-like members as illustrated by FIG. 15 and the arcuate surfaces merge with the U-shaped parts that have sidewalls 62, 62' connected by web portion 64, 64'. In this embodiment, the web portions 64, 64' are adjacent to each other rather than remote from each other as in the embodiment of FIG. 1. The contact arms 36, 38, 36', 38' extend from the sidewalls as previously described and are, if desired, preloaded or resiliently biased as previously described.

Figure 16:
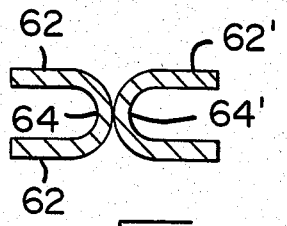

If desired, one or two latch arms 66, 66' can be provided for latching the terminal to a terminal tab 72 which has an opening 70 that receives the laterally extending end portions 68, 68' of the latching arms 66, 66'. The latching arms extend from the webs 64, 64' of the U-shaped parts of the transition portion and since these webs are adjacent to each other as shown in FIG. 16, the latching arms will be between the pairs of contact arms as illustrated in FIG. 12.

It is also practical in the embodiment of FIG. 10 to provide a locking ear 74 which is struck from the arcuate part of one section of the transition portion 56 and which extends from the web 64' to the other section of the transition portion. The end of the locking ear 64 extends through an opening 78 as shown in FIG. 11 and is bent downwardly as shown at 76. This locking ear has the effect of stabilizing the plate members 14, 14' against movement away from each other when a wire is moved into the wire-receiving slots 18, 18'. This feature may be advantageous where relatively heavy wires with relatively tough insulation are being connected to the terminals in a connector.

Figure 17:
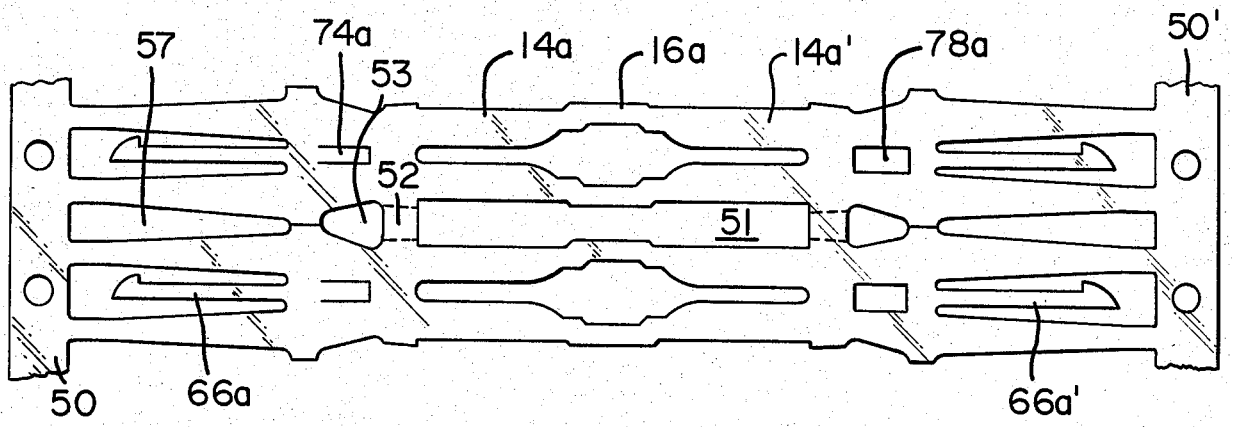
FIG. 17 is a plan view of a short section of a strip of blanks which, when formed, produce the terminal of FIG. 10.

FIG. 17 shows a short section of a strip of blanks from which terminals 54' are formed. In general, the blanks shown in FIG. 17 have the same features as the blanks shown in FIG. 8 and the forming steps described with reference to FIGS. 8 and 9 are carried out in forming terminals 54 from the blanks shown in FIG. 17. FIG. 17 does show the manner in which the latching arms 66*a*, 66*a'* can be provided in the relatively large openings between the contact arms of each terminal. FIG. 17 also shows the opening 78*a* for the locking ear 74*a*.

Figure 18:
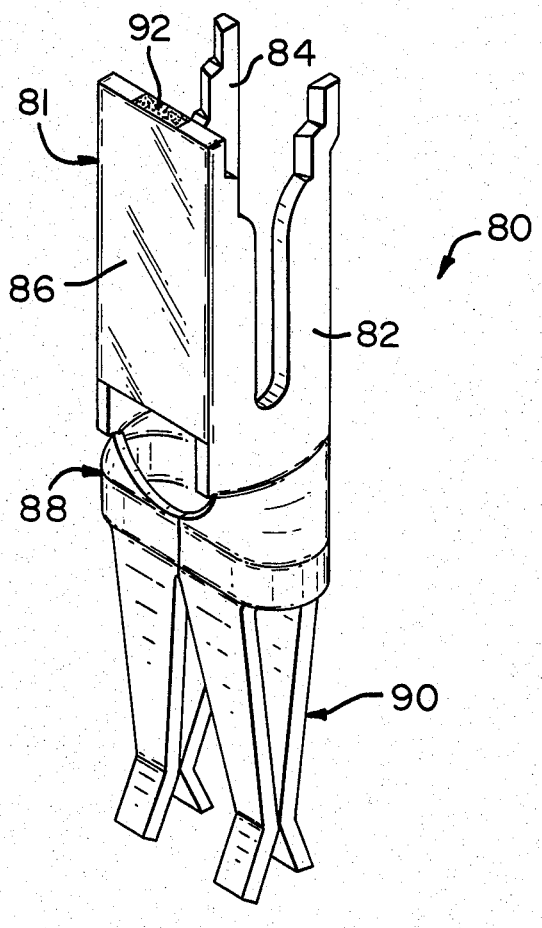
FIG. 18 is a perspective view of a further embodiment of the invention.

FIG. 18 shows another type of terminal 80 incorporating the invention. In this terminal, the conductor-receiving portion 81 has spaced-apart plate-like members 82, 84 which are connected to each other by a web section 86 which is integral with corresponding side edges of the plate-like members on one side of the terminal. The terminal 80 has a transition portion 88 and a contact portion 90 which may be similar to the corresponding transition and contact portions of either of the terminals shown in FIGS. 1 and 10.

The manufacture of terminals of the type shown at 80 would be carried out by producing the blanks for the terminals in side-by-side strip form with adjacent blanks connected to a single carrier strip which would extend from the upper edge 92 of the web 86. The final folding operation after formation of the transition sections would involve folding the plate-like members 84, 82 from the plane of the web 86 into parallel spaced-apart relationship. The wire-receiving slots of the terminal 80 extend inwardly from the upper edges of the two plate-like members 82, 84.

Several advantages are achieved by the use of terminals in accordance with the invention. As explained previously, it is possible to have the contact arms 36, 38, 36', 38' preloaded or resiliently biased against each other and thereby achieve a high contact force in the contact portion. This feature of the invention results from the fact that the transition portions 10, 56, 88 of all of the embodiments contain the U-shaped parts from which the contact arms extend and during formation of this U-shaped part, the contact arms can be preloaded (i.e. resiliently biased) against each other. While a high contact force in the contact arms can be obtained if desired, the terminal designer can have a contact force of an intermediate or lower level inasmuch as he has during the design of the terminal complete control over the factors which give rise to the high contact force. For example, the contact force could be lowered by simply bending the contact arms apart and setting them at a level such that the desired force is achieved. The design of the arms themselves, which are essentially cantilever beams, can similarly be changed to satisfy particular requirements.

A significant advantage is obtained in that a connector 46, FIG. 7, containing any of the types of terminals described above can be mated with terminal tabs 42 located in parallel planes on closely spaced centers. A design standard for terminal tabs 42 specifies that these tabs should be a center-to-center spacing of 7.5 mm. Because of the width of previously known terminals of the type shown in U.S. Pat. No. 4,159,158 (the width between the side edges of the arms in the contact portion), it was impossible to design a connector containing such terminals which could be mated with tabs oriented as shown in FIG. 7. By virtue of the fact that the terminal tab, when mated with a terminal in accordance with the present invention, lies in a plane that extends normally of the plane of the plate-like members 14, 14', a connector can be designed as shown at 46 which can be mated with parallel tabs 42.

The provision of the transition portion as described above provides the terminal designer with a large number of options as regards the form of the contact portion of the terminal as shown at 12 in FIG. 1 at 58 in FIG. 10, and at 90 in FIG. 18. These contact portions might take the form of a multi-layer tab intended for mating with a tab-receiving receptacle, or of a pin or receptacle intended for mating with a complementary receptacle or pin, respectively. Under some circumstances, the "U-shaped part" as shown at 26, 26' may be less severely formed than shown in the drawing and may have divergent sidewalls.

We claim:

1. A stamped and formed electrical terminal of the type having a conductor-receiving end and contact end, a conductor-receiving portion extending from the conductor-receiving end and a contact portion extending from the contact end, and a transition portion between the conductor-receiving portion and the contact portion, the conductor-receiving portion comprising first and second aligned flat plate-like members which are connected to each other, the plate-like members having aligned conductor-receiving slots so that a conductor can be moved laterally of its axis and into the conductor-receiving slots, the transition portion and the contact portion each comprising first and second sections which extend in side-by-side relationship from the first and second plate-like members respectively, the second section of the transition portion being a substantial mirror image of the first section, the terminal being characterized in that:

the first and second sections of the transition portion have arcuate surfaces which are convex with respect to a medial plane that extends parallel to, and is between the planes of the first and second plate-like members and which are contiguous with the first and second plate-like members respectively and have generally U-shaped parts at their junctures with the respective contact portions, the arcuate surfaces of the sections fairing from surfaces of maximum radius to surfaces of minimum radius which in turn merge with the respective U-shaped parts of the sections, the U-shaped parts having opposed sidewalls which are connected to each other by webs, the U-shaped parts being opposed to each other with their webs adjacent to each other and with the sidewalls of the first and second sections remote from each other, the contact portion comprising at least one contact arm which extends from the U-shaped part of the first section.

2. An electrical terminal as set forth in claim 1 characterized in that the contact portion comprises at least a first pair of contact arms, each of which extends from one of the sidewalls of the U-shaped part of the first section of the transition portion.

3. An electrical terminal as set forth in claim 2 characterized in that the first pair of contact arms extend convergently towards each other and are resiliently biased against each other at a location proximate to the contact end.

4. An electrical terminal as set forth in claim 2 characterized in that the contact portion comprises a second pair of contact arms, each of which extends from one of the sidewalls of the U-shaped part of the second section of the transition portion.

5. An electrical terminal as set forth in claim 4 characterized in that the first pair of contact arms extend convergently towards each other, and the second pair of contact arms extend convergently towards each other, the terminal being intended to receive a blade-like terminal between the contact arms of both pairs of contact arms.

6. An electrical terminal as set forth in claim 5 characterized in that the first and second aligned plate-like members of the conductor-receiving portion are connected to each other by spaced-apart connecting straps at the conductor-receiving end of the terminal.

7. An electrical terminal as set forth in claim 5 characterized in that the first and second aligned plate-like members have corresponding side edges, the first and second plate-like members being connected to each other by a connecting web which extends between one corresponding pair of side edges.

8. An electrical terminal as set forth in claim 1 characterized in that the contact portion comprises first and second pairs of contact arms in the first and second sections respectively, each pair of contact arms projecting as extensions of the sidewalls of the U-shaped parts of the first and second sections of the transition portion.

9. An electrical terminal as set forth in claim 8 characterized in that the contact arms of each pair extend convergently towards each other and are resiliently biased against each other at a location proximate to the contact end of the terminal.

10. An electrical terminal as set forth in claim 9 characterized in that at least one latch arm is provided in the contact portion for latching the terminal to a complementary terminal, the latch arm projecting as an extension of the web of the U-shaped part of the first section, the latch arm having engaging means for engaging complementary engaging means on a complementary terminal.

11. An electrical terminal as set forth in claim 10 characterized in that a second latch arm projects as an extension of the web of the U-shaped part of the second section.

12. An electrical terminal as set forth in claim 8 characterized in that a locking ear extends from the web portion of the U-shaped part of one of the sections laterally of the longitudinal axis of the terminal to the web portion of the U-shaped part of the other section and is in locking engagement with the other section.

13. A stamped and formed electrical terminal of the type having a conductor-receiving end and a contact end, a conductor-receiving portion extending from the conductor-receiving end and a contact portion extending from the contact end, and a transition portion between the conductor-receiving portion and the contact portion, the conductor-receiving portion comprising first and second aligned spaced apart flat plate-like members which are connected to each other, the plate-like members having aligned conductor-receiving slots so that a conductor can be moved laterally of its axis and into the conductor-receiving slots, the transition portion and the contact portion each comprising first and second sections which extend in side-by-side relationship from the first and second plate-like members respectively, the terminal being characterized in that:

the first and second sections of the transition portion are inclined from the first and second plate-like members towards each other and towards a medial plane that is between, and extends parallel to, the planes of the first and second plate-like members and the first and second sections of the contact portion each comprises a pair of opposed contact arms which extend from the first and second sections of the transition portion respectively, the pairs of contact arms being oriented to receive a terminal tab therebetween that lies in a plane that extends normally of the planes of the first and second plate-like members.

14. A stamped and formed electrical terminal as set forth in claim 13 characterized in that the first and second sections of the transition portion each has an arcuate surface which is generally U-shaped in cross section, the arcuate surfaces being contiguous with the first and second plate-like members, the contact arms extending from the arcuate surfaces.

* * * * *